US011841160B1

(12) United States Patent
Mickey

(10) Patent No.: US 11,841,160 B1
(45) Date of Patent: Dec. 12, 2023

(54) AIR HANDLER COIL ACCESS

(71) Applicant: Christopher Mickey, New Port Richey, FL (US)

(72) Inventor: Christopher Mickey, New Port Richey, FL (US)

( * ) Notice: Subject to any disclaimer, the term of this patent is extended or adjusted under 35 U.S.C. 154(b) by 0 days.

(21) Appl. No.: 18/139,756

(22) Filed: Apr. 26, 2023

(51) Int. Cl.
*F24F 13/02* (2006.01)

(52) U.S. Cl.
CPC ..... *F24F 13/029* (2013.01); *F24F 13/0254* (2013.01); *F24F 13/0263* (2013.01)

(58) Field of Classification Search
CPC ... F24F 13/029; F24F 13/0254; F24F 13/0263
USPC ..... 49/463; 138/92
See application file for complete search history.

(56) References Cited

U.S. PATENT DOCUMENTS 2,866,572 A * 12/1958 Llewhellin ..... B60K 15/0406 220/293
3,773,086 A * 11/1973 Kurz ..... F16L 55/10 138/92
3,782,411 A * 1/1974 Turner ..... F16L 45/00 137/526
4,217,930 A * 8/1980 Lerner ..... B63J 2/08 220/366.1
4,334,630 A * 6/1982 Bergin ..... B62D 25/24 174/67
4,667,449 A * 5/1987 Keating ..... F16L 45/00 138/92
5,165,189 A 11/1992 Besal
5,901,502 A * 5/1999 Rafalski ..... F24F 13/0263 49/463
6,684,569 B2 * 2/2004 Gineris ..... B64G 1/002 244/129.4
6,782,708 B1 8/2004 Boer
8,656,645 B1 * 2/2014 Chwala ..... E05B 65/006 49/465
8,876,078 B1 11/2014 Gates
9,267,702 B2 2/2016 Santini et al.
2015/0013251 A1 1/2015 Waelde et al.

FOREIGN PATENT DOCUMENTS

WO WO-2004013543 A1 * 2/2004 ..... F24F 13/02

* cited by examiner

*Primary Examiner* — Craig M Schneider
*Assistant Examiner* — David R Deal
(74) *Attorney, Agent, or Firm* — Nicholas Pfeifer; Smith & Hopen, P.A.

(57) ABSTRACT

An access device configured to be installed in an air conditioning (AC) system or network. The access device includes a main body and a lid configured to threadedly engage the main body. A hollow cylindrical extension extends between a proximal end and a distal end, thereby establishing a passage through the main body. The access device can be secured to a wall in an AC system with the cylindrical extension passing through a hole in the wall. The access device further includes a flange extending outwardly in a lateral direction relative to the central longitudinal axis. Some embodiments include a plurality of anti-rotation teeth attached to the flange. Some embodiments include an insulation support extending inwardly from the cylindrical extension to temporarily support insulation within the cylindrical extension between the lid and the insulation support.

19 Claims, 6 Drawing Sheets

AIR HANDLER COIL ACCESS

BACKGROUND OF THE INVENTION

1. Field of the Invention

This invention relates, generally, to air conditioning systems and components. More specifically, it relates to an access device to be installed in one or more sections of an air conditioning system.

2. Brief Description of the Prior Art

Home and building air conditioning (AC) systems include a set of coils that will collect dirt and debris over time. To ensure that the AC system maintains optimal efficiency and efficacy, the coils need to be cleaned periodically. Accessing these coils, and other areas in an AC system/network, however, can be challenging. Accordingly, what is needed is an access device that allows individuals to access an AC system/network more easily. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an AC system/network access device is now met by a new, useful, and nonobvious invention.

The access device includes a main body and a lid. The main body has a proximal end and a distal end with a central longitudinal axis extending from the proximal end to the distal end. A hollow cylindrical extension extends between the proximal end and the distal end, thereby establishing a passage through the main body. The access device can be secured to a wall in an AC system with the cylindrical extension passing through a hole in the wall.

In some embodiments, the cylindrical extension has an inner diameter between about 4 inches and about 12 inches. In some embodiments, the cylindrical extension has a length of about 1.5 inches from the flange to the distal end of the main body.

The lid can have a circular shape and a first thread. The first thread is configured to operably engage a second thread on an internal surface of the cylindrical extension. The threads enable the lid to threadedly engage the main body to temporarily close the passage through the main body.

The lid can further include a discontinuous handle located on a proximal surface of the lid. The discontinuity establishes a central gap configured to receive an object thereby enabling a user to increase a torque force applied to the lid during rotation.

The access device further includes a flange extending outwardly in a lateral direction relative to the central longitudinal axis. The flange is located proximate to the first end of the main body, providing a surface that is adapted to abut a wall when the cylindrical extension resides within a hole in the wall.

Some embodiments include a plurality of anti-rotation teeth attached to the flange. Each tooth has an insertion orientation in which the tooth is directed at least partially in a distal direction. Some embodiments include a plurality of fastener receipts disposed in the flange to receive fasteners.

The access device can further include an insulation support extending inwardly from the cylindrical extension. The insulation support is longitudinally offset in the distal direction relative to the lid when the lid is secured to the main body. The offset provides room for insulation to temporarily reside within the cylindrical extension between the lid and the distal end of the main body. In some embodiments, the insulation support is longitudinally offset from the lid a distance equal to or less than about 1.5 inches.

Some embodiments further include a flange seal on a distal surface of the flange and/or a gasket seal disposed around a circumference of the lid adjacent to the first thread. Some embodiments of the access device further include a circumferential guard extending proximally from the flange.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
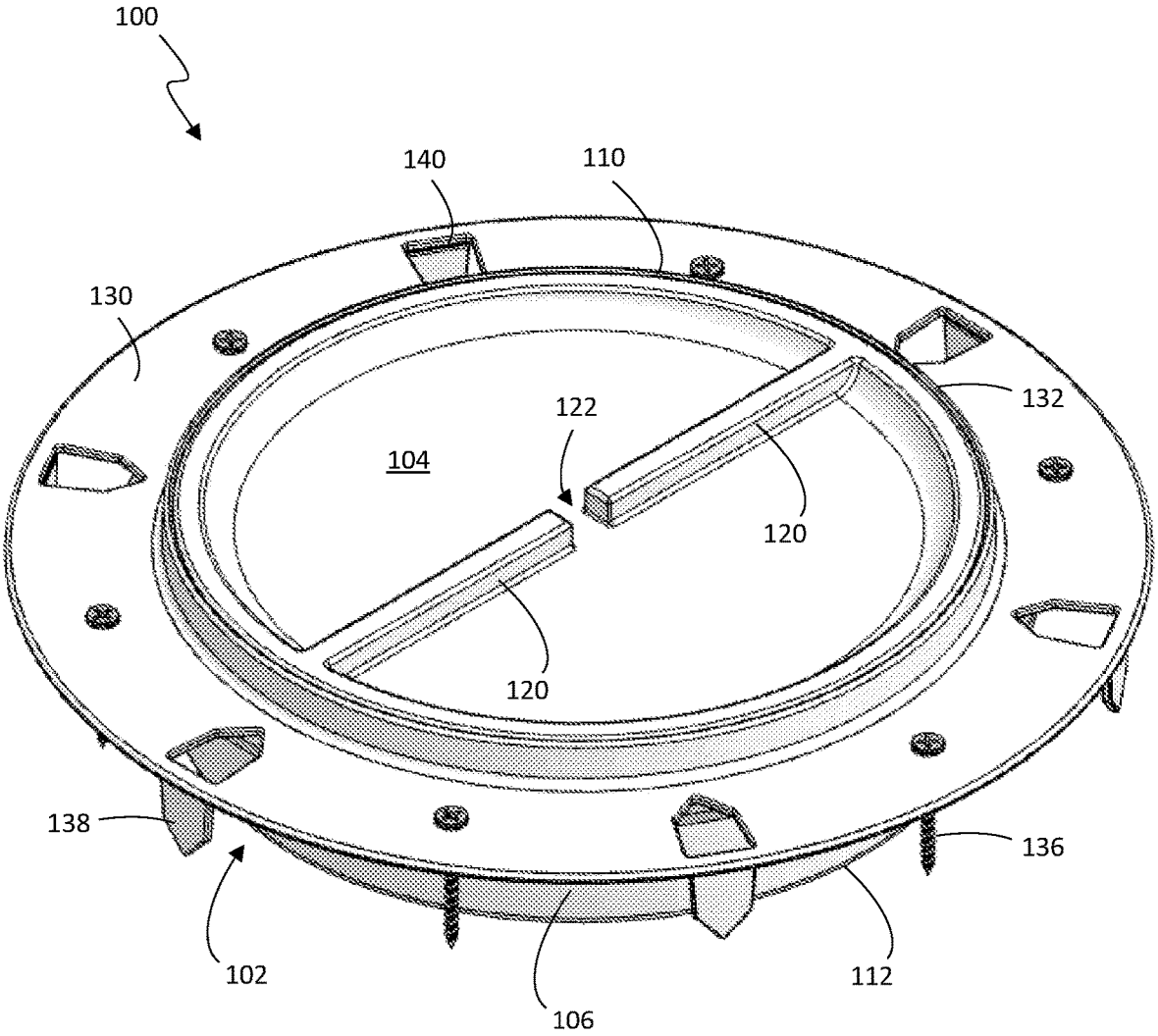
FIG. 1 is a perspective view of an embodiment of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

As used herein, the term "about" means approximately or nearly. In the context of a numerical value or range, the term "about" means ±15% of the numerical value.

The present invention includes an access device configured to be installed in an air conditioning (AC) system or network. In some embodiments, the access device is configured to be installed adjacent to a set of coils in an air handler with a portion of the access device passing through a hole that is premanufactured or cut into a surface in the AC system, such as duct board located proximate to the coils. The access device may include one or more mechanisms or methods for securing the access device in ductwork, duct board, drywall, wood, etc. Hereinafter the access device will be described in relation to the installation through a hole in duct board for exemplary purposes, however, it should be understood that the access device can be installed though holes in other types of walls/surfaces and reference to the installation in duct board in the specification is not limiting.

Referring now to the Figures, access device 100 includes main body 102 and lid 104. Main body 102 includes proximal end 110 and distal end 112. Proximal end 110 is intended to remain external from the duct board on which access device 100 is secured. Distal end 112 is intended to pass through the duct board on which access device 100 is secured. Main body 102 further includes a hollow extension 106 that establishes passage 108. Passage 108 provides a port through which a user can insert a limb or tool to access internal objects, such as the coils in an air handler.

While hollow extension 106 is depicted as a cylindrical extension, hollow extensions with alternative shapes can be used. However, cylindrical extensions include additional benefits over other shapes. First, its much easier to cut a circular hole in duct board and other surfaces for installation and there is no required additional steps for properly orienting a hole to ensure that the access device is oriented in a particular manner. Second, a passage with a circular cross-section provides 360 degrees of access and improves the ease with which a user can clean coils or perform other tasks within the internal area. Third, it's easier to cut insulation 146 (as will be explained in greater detail in subsequent paragraphs) into a cylindrical shape. For the sake of brevity, hollow extension 106 will be referred to hereinafter as a cylindrical extension.

Figure 4:
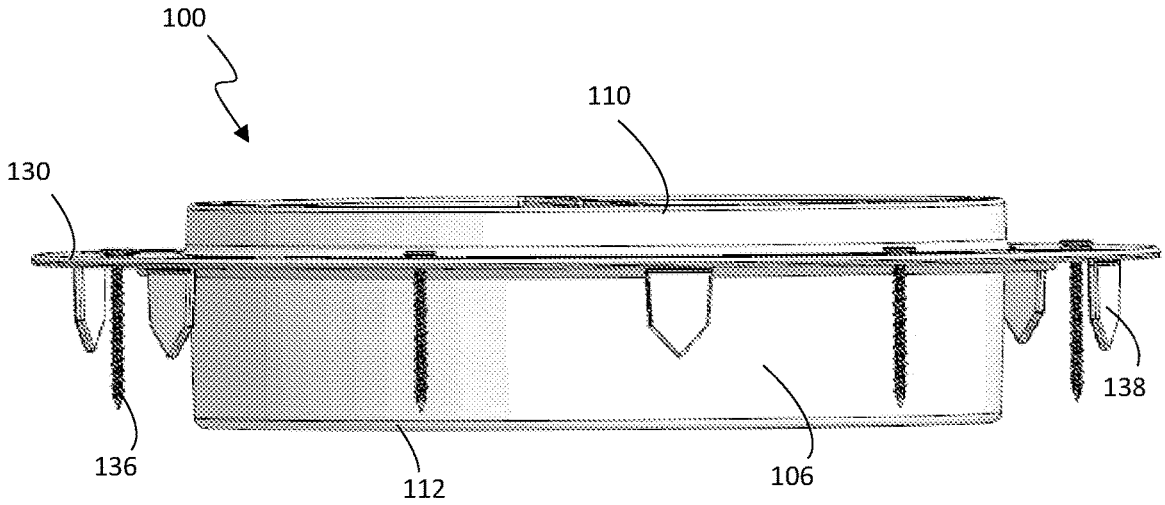
FIG. 4 is a side view of an embodiment of the present invention.

Lid 104 is configured to temporarily attach to proximal end 110 of main body 102. As depicted in FIG. 4, in some embodiments, lid 104 includes thread 114 and main body 102 includes a corresponding thread 116, such that lid 104 can threadedly engage main body 102. The threaded attachment is less susceptible to damage in comparison to alternative options. However, alternative embodiments may use alternative devices and methods for temporarily attaching lid 104 to main body 102.

As best depicted in FIGS. 4-7, lid 104 is secured to internal surface 118 of cylindrical extension 106 and generally at proximal end 110. Securing lid 104 to internal surface 118 minimizes the proximal extent of lid 104, which can be important when considering that access device 100 may be secured within an AC closet with minimal clearance for such a device. Securing lid 104 to internal surface 118 also has the added benefit of protecting threads 114 and 116 or other attachment mechanisms from contact with external objects that could damage the attachment mechanisms.

Lid 104 includes one or more handles 120. Handle(s) 120 are also recessed to reduce the proximal extent for similar reasons as described above. In some embodiments, handle(s) 120 do not extend proximally beyond proximal end 110 of main body 102. Handle(s) 120, however, have an overall height sufficient to allow a user to grasp handle(s) 120 for rotating lid 104.

Figure 2:
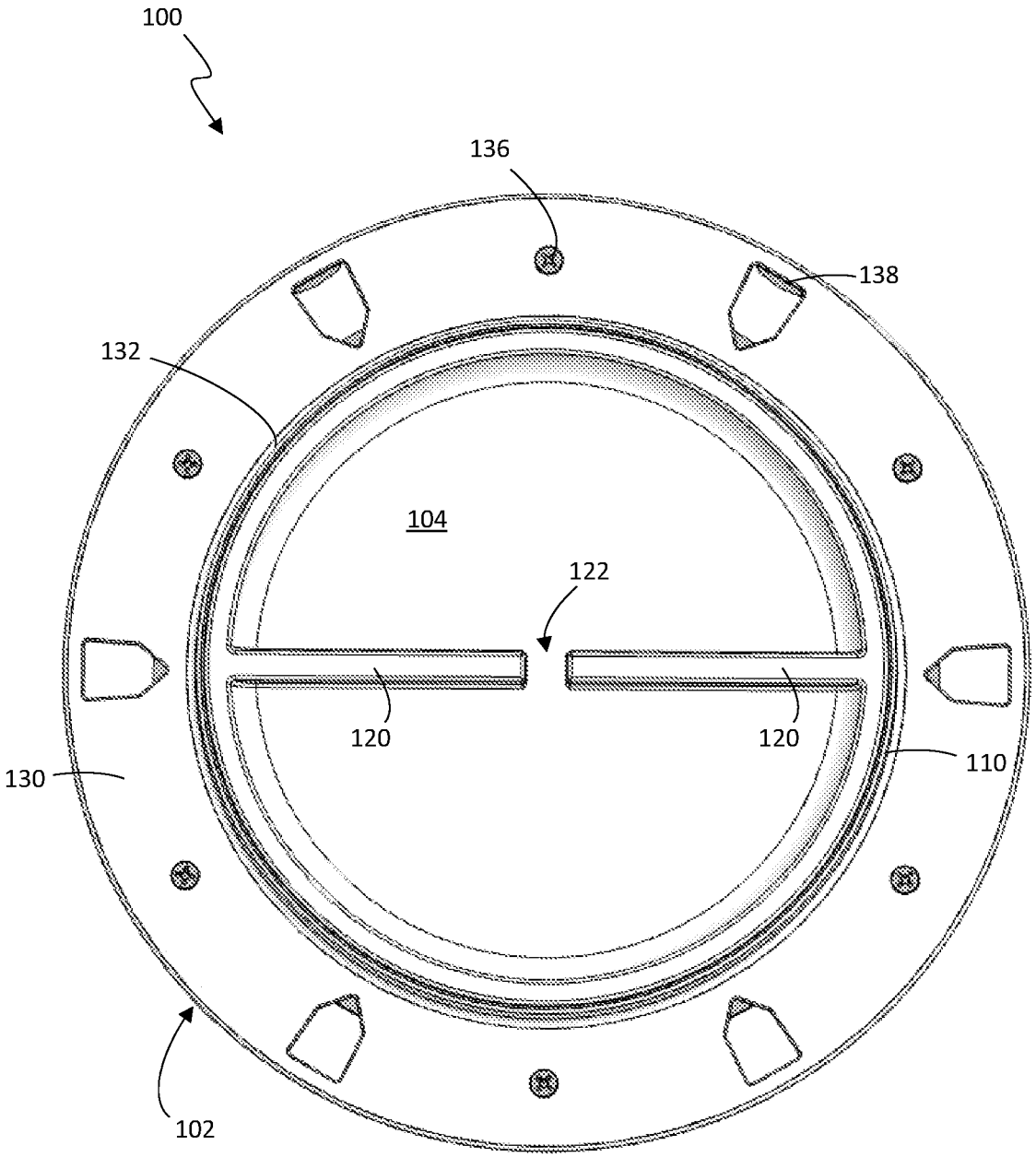
FIG. 2 is a top view of an embodiment of the present invention.
Figure 3:
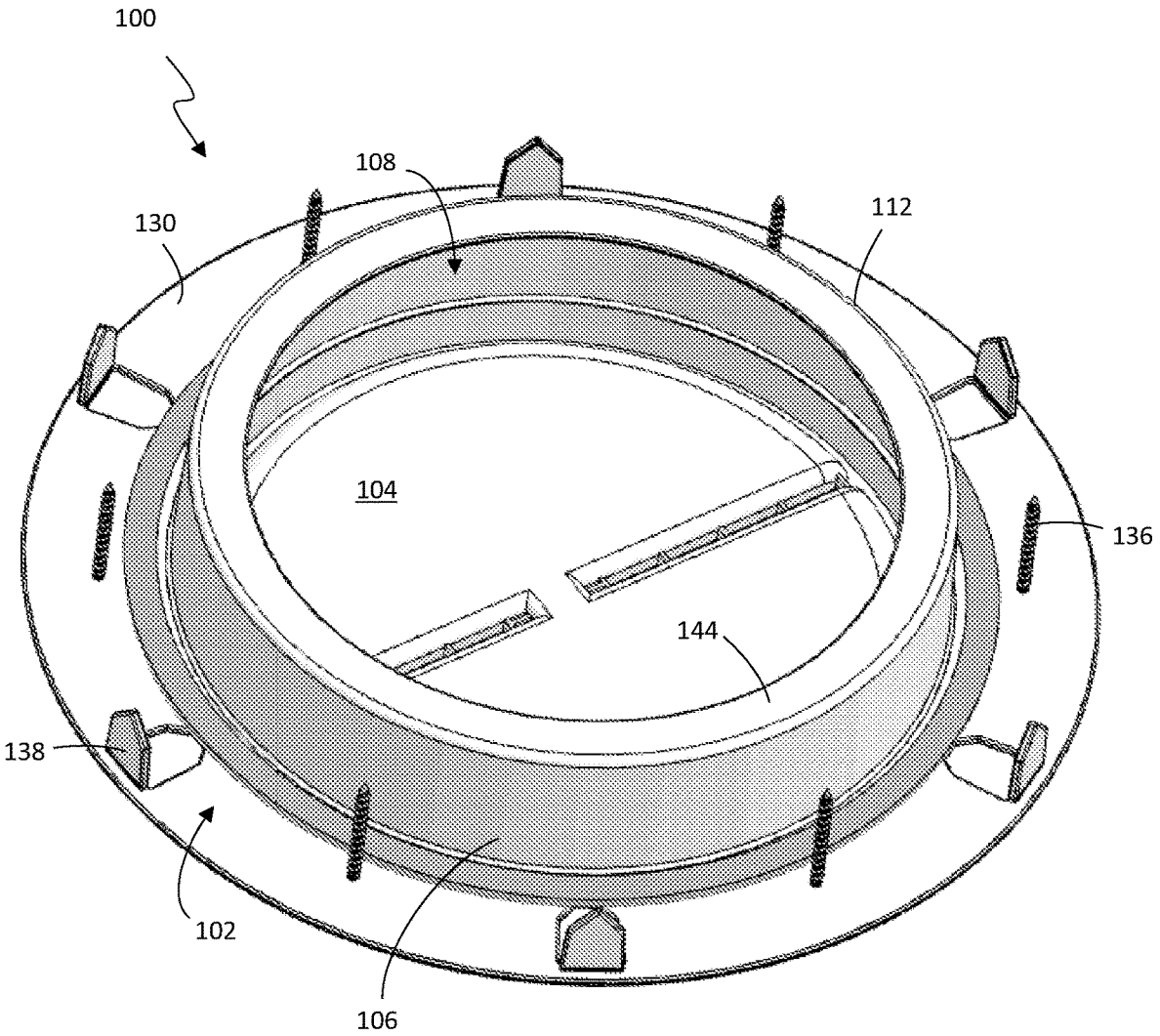
FIG. 3 is a bottom perspective view of an embodiment of the present invention.

In some embodiments, as best depicted in FIGS. 1-2, lid 104 includes a pair of handles 120 with central gap 122 between the two handles. Described in another way, lid 104 includes a discontinuous handle 120 establishing central gap 122 between the two portions of handle 120. Central gap 122 provides a tool receiving area. A user can temporarily insert a tool in central gap 122 and use the tool to increase a user's ability to apply greater torque to rotate lid 104 more easily. Some embodiments of lid 104 include more than two handle(s) 120 and one or more gaps 122 to accept different tools and aid the user in opening and closing lid 104.

Figure 5:
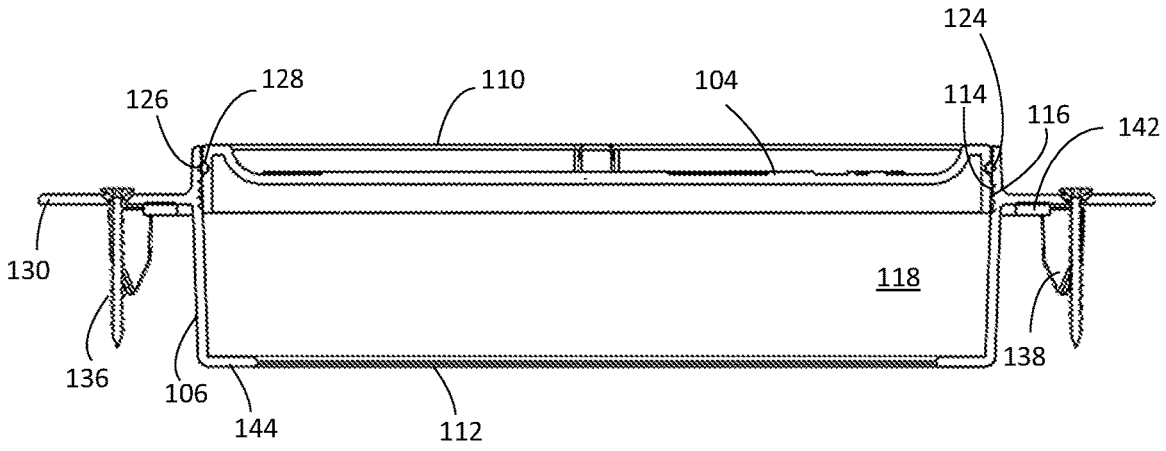
FIG. 5 is a cross-sectional view of an embodiment of the present invention.

Referring back to FIGS. 4-7, some embodiments of access device 100 further include gasket seal 124 to provide a fluidic seal between lid 104 and main body 102 thereby preventing or minimizing air passing between the two when lid 104 is secured to main body 102. In some embodiments, lid 104 includes seal channel 126 and internal surface 118 includes a corresponding seal channel 128. As illustrated in FIG. 5, channels 126 and 128 are located the same distance from their respective threads 114 and 116 to ensure that seal 124 will reside in the channels when lid 104 is fully tightened to main body 102.

Main body 102 further includes lateral flange 130 or a plurality of discontinuous flanges 130. Flange(s) 130 generally extend laterally in an outward direction away from a central longitudinal axis of hollow extension 106. When extension 106 is cylindrical, flange(s) 130 extend radially in an outward direction from cylindrical extension 106. The lateral/radial extent is sufficient to provide an attachment surface for securing main body 102 to the duct board when cylindrical extension 106 resides within a hole in the duct board.

In some embodiments, flange(s) 130 are closer to proximal end 110 than distal end 112. Some embodiments, however, include flange(s) 130 offset distally from proximal end 110 to establish circumferential guard 132 extending proximally from flange(s) 130. Circumferential guard 132 provides a barrier between threads 114, 116 and any tape, adhesive, mastic, etc. used to secure flange(s) 130 to the surface of the duct board. Thus, circumferential guard 132 prevents the accidental application of these adhesives between lid 104 and main body 102. In some embodiments, circumferential guard 132 has a proximal extent of about 0.25 inches to about 1 inch.

In some embodiments, flange(s) 130 includes a plurality of fastener receipts 134 configured to receive fasteners (e.g., screws 136) to secure main body 102 to the surface of an object. The plurality of fastener receipts 134 can be equidistantly spaced about the circumference of flange(s) 130.

In some embodiments, flange(s) 130 includes a plurality of anti-rotation spikes 138. Anti-rotation spikes are configured to pierce the surrounding duct board and prevent rotation of main body 102 when lid 104 is rotated into and out of main body 102. Thus, anti-rotation spikes 138 each include a tapered distal tip and can be equidistantly spaced about the circumference of main body 102.

In some embodiments, anti-rotation spikes 138 are preset in a distally projecting orientation to pierce surrounding duct board. However, some embodiments of access device 100 are intended to be used on other objects and materials. For example, flange(s) 130 or a portion of flange(s) 130 may be secured to a wood material and anti-rotation spikes 138 may be unable to pierce such material. Thus, some embodiments include anti-rotation spikes 138 that are hingedly connected to flange(s) 130 and have an initial orientation in which they reside in a generally planar orientation with respect to flange(s) 130. As best shown in FIG. 1, such embodiments include hinged connection 140, which can be a living hinge, using e.g., a scored line, or can include a mechanical hinge.

To reduce rotation in both the clockwise and counterclockwise directions, anti-rotation spikes 138 can be oriented so that rotation in either direction does not cause anti-rotation spikes 138 to pivot about hinged connection 140. For example, hinged connection 140 of anti-rotation spikes 138 can be oriented in a direction that is generally perpendicular to a radial direction as depicted in the Figures. In some embodiments, hinged connection 140 is oriented so that a first portion of anti-rotation spikes 138 hinge downward into the insertion orientation a first direction and a second portion of anti-rotation spikes 138 hinge downward into the insertion orientation in a second direction. The first portion would prevent rotation of main body 102 in a clockwise direction and the second portion would prevent rotation of main body 102 in a counterclockwise direction.

In some embodiments, anti-rotation spikes 138 have a downward extent, when oriented in the downward insertion orientation, that is less than the depth of the duct board in which the spikes are intended to penetrate. This relative depth prevents anti-rotation spikes 138 from penetrating completely through the duct board, which would result in air leakage. In some embodiments, anti-rotation spikes 138 have a downward extent that is less than 1.5 inches.

As best shown in FIGS. 4-8, some embodiments of access device 100 include flange seal 142. Flange seal 142 provides a fluidic seal between flange(s) 130 and the surrounding surface on which flange(s) 130 are secured, thereby preventing or minimizing air passing between the two. In some embodiments, flange(s) 130 include a seal channel to receive flange seal 142.

As previously explained, distal end 112 of main body 102 is intended to pass through a hole cut into duct board or another object. In some embodiments, cylindrical extension 106 has a sufficient length to ensure that distal end 112 reaches completely through the hole or is flush with the internal surface of the object. Cylindrical extension 106 thereby provides a user with access to the internal area of the object and ensures that the side walls of cylindrical extension 106 protect the user from the cut surface of the surrounding material. Considering duct board as an example, cutting a hole into duct board will expose the internal fiberglass sandwiched between two layers of foil. Fiberglass can be harmful if it comes into contact with a person's skin. To eliminate this risk, cylindrical extension 106 has a sufficient length to ensure that once it passes through the hole in the duct board, it acts as a barrier between the user and the fiberglass in the duct board. Accordingly, cylindrical extension 106 has a length that is at least the thickness of the duct board or object wall. In some embodiments, that length of cylindrical extension 106 from the underside of flange(s) 130 to distal end 112 is about 1.5 inches, which is a standard thickness of duct board.

As noted above, cylindrical extension 106 is also intended to provide a user with access to an internal area of the object to which access device 100 is secured. To provide an adequately sized opening, cylindrical extension 106 has a diameter between about 4 inches and about 12 inches. In some embodiments, cylindrical extension 106 has a diameter between about 4 inches and about 8 inches. In some embodiments, cylindrical extension 106 has a diameter of about 8 inches.

Figure 6:
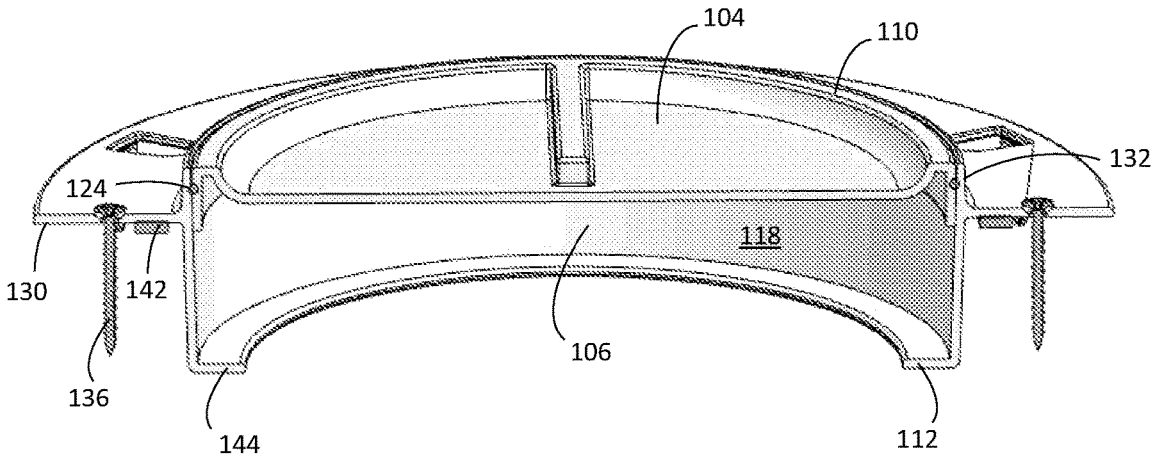
FIG. 6 is a cross-sectional perspective view of an embodiment of the present invention.

As best depicted in FIGS. 4-6, some embodiments of access device 100 further include insulation support 144 extending inwardly toward the central longitudinal axis of cylindrical extension 106. Insulation support 144 as depicted is an annular support, however, some embodiments can be comprised of a plurality of discontinuous inwardly extending flanges. The inward projection of insulation support 144 is generally minimized to avoid overly narrowing passage 108. In some embodiments, the inward projection of insulation support 144 is about 0.5 inches.

Figure 7:
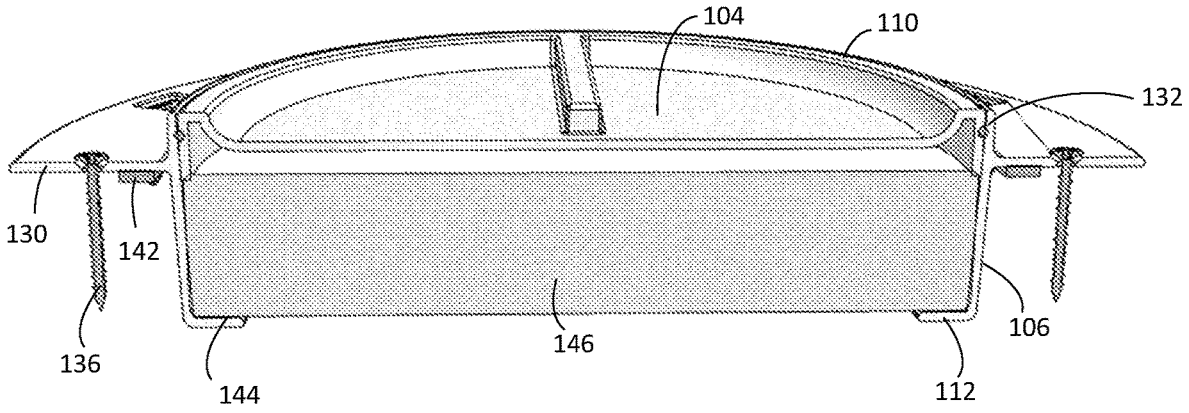
FIG. 7 is a cross-sectional perspective view of an embodiment of the present invention with insulation in the hollow extension.
Figure 8:
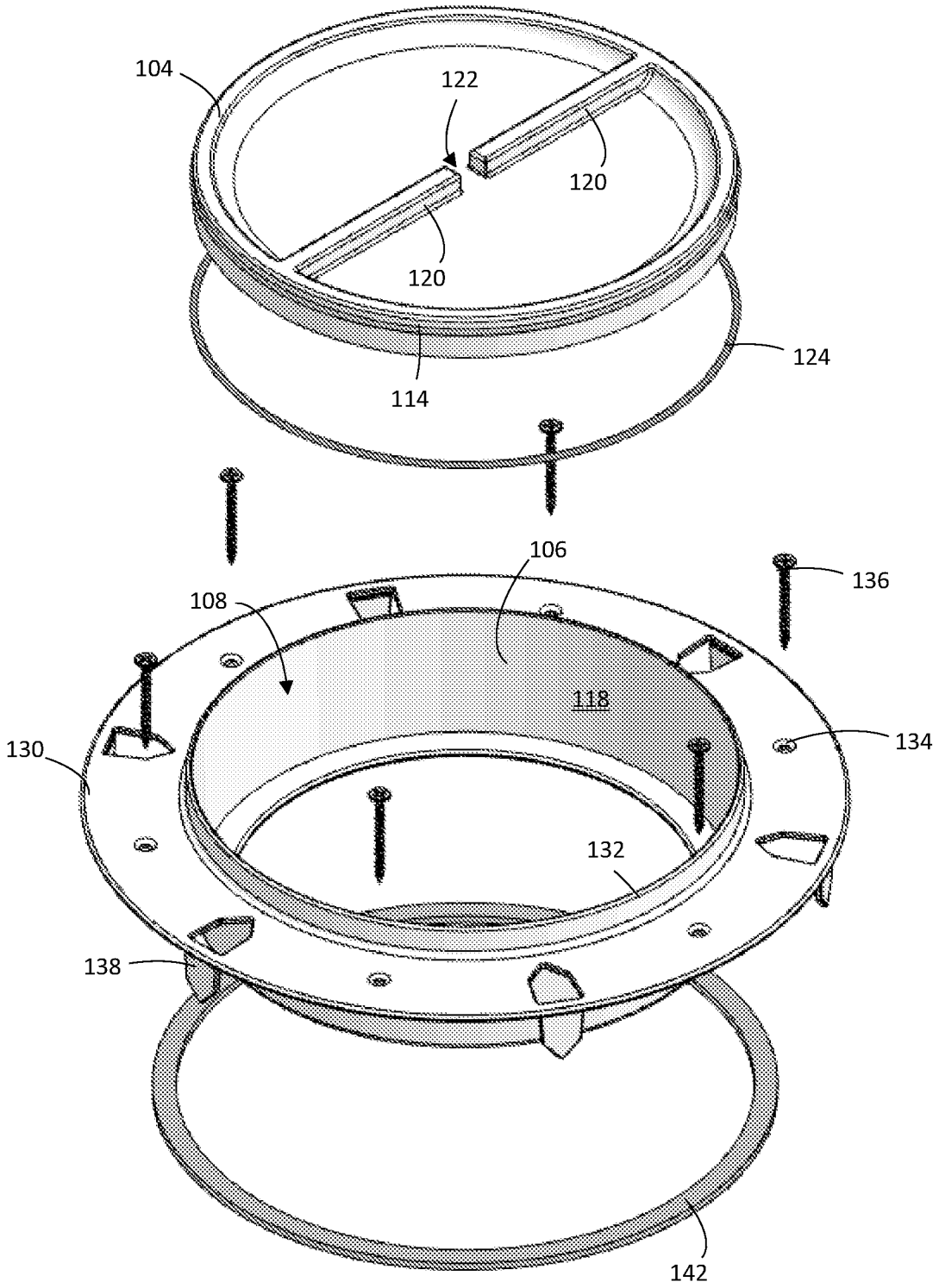
FIG. 8 is an exploded view of an embodiment of the present invention.

Insulation support 144 is a distally located support intended to retain a section of insulation, such as duct board, within cylindrical extension 106, which is depicted in FIG. 7. Thus, some embodiments of access device 100 further include cylindrically shaped insulation 146. Insulation 146 is configured to tightly fit within cylindrical extension 106 and includes a thickness that is equal to or slightly larger than the longitudinal distance between insulation support 144 and the bottom most section of lid 104 when lid 104 is secured to main body 102. In some embodiments, this spacing is equal to or slightly less than 1.5 inches to snuggly accommodate insulation 146 comprised of duct board having a thickness of 1.5 inches.

Some embodiments can include insulation 146 secured to lid 104. However, insulation 146 could breakdown quicker if subject to repeated rotational forces when opening and closing lid 104. Thus, some embodiments include insulation 146 freely disposed in cylindrical extension 106 with lid 104 applying a compression force when fully tightened onto main body 102.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An air handler coil access device, comprising:

a main body having a proximal end and a distal end with a central longitudinal axis extending from the proximal end to the distal end;

a hollow cylindrical extension extending between the proximal end and the distal end, wherein the cylindrical extension establishes a passage through the main body;

a flange extending outwardly in a lateral direction relative to the central longitudinal axis, wherein the flange is located proximate to the first end of the main body;

a plurality of anti-rotation teeth attached to the flange, each tooth of the plurality of anti-rotation teeth having an insertion orientation in which each tooth is directed at least partially in a distal direction;

a circular lid having a first thread, the first thread configured to operably engage a second thread on an internal surface of the cylindrical extension, thereby enabling the lid to threadedly engage the main body to temporarily close the passage through the main body;

wherein the access device can be secured to a wall in an air conditioning system with the cylindrical extension passing through a hole in the wall and the flange providing a surface that is adapted to abut the wall when the cylindrical extension resides within the hole in the wall.

2. The access device of claim 1, further including a flange seal on a distal surface of the flange.

3. The access device of claim 1, further including gasket seal disposed around a circumference of the lid adjacent to the first thread.

4. The access device of claim 1, further including a plurality of fastener receipts disposed in the flange.

5. The access device of claim 1, wherein the cylindrical extension has an inner diameter between about 4 inches and about 12 inches and a length of about 1.5 inches from the flange to the distal end of the main body.

6. The access device of claim 1, further including a discontinuous handle located on a proximal surface of the lid, wherein the discontinuity establishes a central gap configured to receive an object thereby enabling a user to increase a torque force applied to the lid during rotation.

7. The access device of claim 1, further including an insulation support extending inwardly from the cylindrical extension, wherein the insulation support is longitudinally offset in the distal direction relative to the lid when the lid is secured to the main body.

8. The access device of claim 7, wherein the insulation support is longitudinally offset a distance equal to or less than about 1.5 inches.

9. The access device of claim 1, further including a circumferential guard extending proximally from the flange.

10. An air conditioning access device, comprising:

a main body having a proximal end and a distal end with a central longitudinal axis extending from the proximal end to the distal end;

a hollow cylindrical extension extending between the proximal end and the distal end, wherein the cylindrical extension establishes a passage through the main body;

a flange extending outwardly in a lateral direction relative to the central longitudinal axis, wherein the flange is located proximate to the first end of the main body;

a circular lid having a first thread, the first thread configured to operably engage a second thread on an internal surface of the cylindrical extension, thereby enabling the lid to threadedly engage the main body to temporarily close the passage through the main body;

a gasket seal disposed around a circumference of the lid adjacent to the first thread;

wherein the access device can be secured to a wall in an air conditioning system with the cylindrical extension passing through a hole in the wall and the flange providing a surface that is adapted to abut the wall when the cylindrical extension resides within the hole in the wall.

11. The access device of claim 10, further including a flange seal on a distal surface of the flange.

12. The access device of claim 10, further including a plurality of fastener receipts disposed in the flange.

13. The access device of claim 10, wherein the cylindrical extension has an inner diameter between about 4 inches and about 12 inches and a length of about 1.5 inches from the flange to the distal end of the main body.

14. The access device of claim 10, further including a discontinuous handle located on a proximal surface of the lid, wherein the discontinuity establishes a central gap configured to receive an object thereby enabling a user to increase a torque force applied to the lid during rotation.

15. The access device of claim 10, further including a plurality of anti-rotation teeth attached to the flange, each tooth of the plurality of anti-rotation teeth having an insertion orientation in which each tooth is directed at least partially in the distal direction.

16. The access device of claim 10, wherein the insulation support is longitudinally offset from the lid a distance equal to or less than about 1.5 inches.

17. The access device of claim 10, further including a circumferential guard extending proximally from the flange.

18. An air conditioning access device, comprising:

a main body having a proximal end and a distal end with a central longitudinal axis extending from the proximal end to the distal end;

a hollow cylindrical extension extending between the proximal end and the distal end, wherein the cylindrical extension establishes a passage through the main body;

a flange extending outwardly in a lateral direction relative to the central longitudinal axis, wherein the flange is located proximate to the first end of the main body;

a circular lid having a first thread, the first thread configured to operably engage a second thread on an internal surface of the cylindrical extension, thereby enabling the lid to threadedly engage the main body to temporarily close the passage through the main body;

a plurality of anti-rotation teeth attached to the flange, each tooth of the plurality of anti-rotation teeth having an insertion orientation in which each tooth is directed at least partially in a distal direction;

a circumferential guard extending proximally from the flange;

wherein the access device can be secured to a wall in an air conditioning system with the cylindrical extension passing through a hole in the wall and the flange providing a surface that is adapted to abut the wall when the cylindrical extension resides within the hole in the wall.

19. The access device of claim 18, further including an insulation support extending inwardly from the cylindrical extension, wherein the insulation support is longitudinally offset in a distal direction relative to the lid when the lid is secured to the main body.

* * * * *